United States Patent [19]

Lindae et al.

[11] Patent Number: 4,755,919

[45] Date of Patent: Jul. 5, 1988

[54] ANTIGLARE HEADLAMP PARTICULARLY A RECTANGULAR REFLECTOR TYPE HEADLAMP FOR MOTOR VEHICLES

[75] Inventors: Gerhard Lindae, Leonberg; Rainer Neumann; Peter Perthus, both of Stuttgart, all of Fed. Rep. of Germany

[73] Assignee: Robert Bosch GmbH, Stuttgart, Fed. Rep. of Germany

[21] Appl. No.: 87,686

[22] Filed: Aug. 19, 1987

[30] Foreign Application Priority Data

Aug. 21, 1986 [DE] Fed. Rep. of Germany ..... 3628441

[51] Int. Cl.[4] ..... F21V 7/09

[52] U.S. Cl. ..... 362/304; 362/297; 362/346

[58] Field of Search ..... 362/61, 297, 304, 346, 362/302, 309

[56] References Cited

U.S. PATENT DOCUMENTS

| | | | |
|---|---|---|---|
| 1,306,511 | 6/1919 | Ames, Jr. | 362/304 |
| 1,546,281 | 7/1925 | Brown | 362/297 |
| 3,688,149 | 8/1972 | Pitkjaan | 362/346 X |
| 4,530,042 | 7/1985 | Cibié et al. | 362/309 |
| 4,612,608 | 9/1986 | Peitz | 362/297 |

*Primary Examiner*—Samuel Scott
*Assistant Examiner*—Allen J. Flanigan
*Attorney, Agent, or Firm*—Michael J. Striker

[57] ABSTRACT

The reflection surface of a rectangular reflector for a lower beam headlamp is composed of four sectors delimited by transition lines. Two diametrically opposed left and right sectors (11, 12) form a part of a paraboloid projecting a hot light spot. The diametrically opposed upper and lower sectors (13, 14) are part of a paraboloid-ellipsoid defining a parabola in its vertical center section and an ellipsis in its horizontal center section. The latter sectors project a light spot having a broad light dispersion and an increased front field illumination. The reflected light beam corresponds substantially to a dimmed lower light beam to be projected on the road so that a light dispersing glass of the headlamp does not require any optical means for light beam adjustment.

7 Claims, 2 Drawing Sheets

ANTIGLARE HEADLAMP PARTICULARLY A RECTANGULAR REFLECTOR TYPE HEADLAMP FOR MOTOR VEHICLES

BACKGROUND OF THE INVENTION

The present invention relates to an antiglare or low beam headlamp for motor vehicles, particularly for a rectangular reflector type headlamp. Headlamps of this type to be permitted in the U.S.A. must generate a lower beam whose light distribution corresponds to the U.S. rule J 579 c. This lower light beam for illuminating a roadway is shaped both by the configuration of the reflector and by optical means provided on the light diffusing glass in the aperture of the reflector.

For technical and optical reasons in manufacturing a headlamp, the reflector is usually made with a simple configuration to reflect an untreated or initial light beam; in order to obtain from the initial light beam a lower or dimmed light beam the optical means must perform different functions and this requirement complicates the manufacture of the light diffusing glass and causes a substantial deviation of the dimmed light beam from the prescribed light distribution.

SUMMARY OF THE INVENTION

It is therefore a general object of the present invention to overcome the disadvantages of the prior art lower beam headlamps of this kind.

In particular, it is an object of this invention to provide a lower beam headlamp which solves the aforementioned problems encountered during manufacture with very simple technological means.

The invention is based on the idea to immediately adjust the configuration of the reflector in such a manner that the distribution of light in the initial or untreated light beam generated by the reflector comes close to the prescribed distribution and consequently only a limited number of simple optical measures are necessary on the light diffusing glass.

This measure thus considerably simplifies the manufacture of the light diffusing glass and lower dimming values are obtained.

In a further advantageous elaboration of this invention it is achieved that after the conventional turning of the reflector to the right, the dimmed distribution of the untreated light beam fairly approaches the light distribution on the prescribed dimmed beam. In further elaborations of this invention the approximation of the initial light beam to the desired one is still increased and various parameters of the reflector are adjusted one to each other in an advantageous way.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
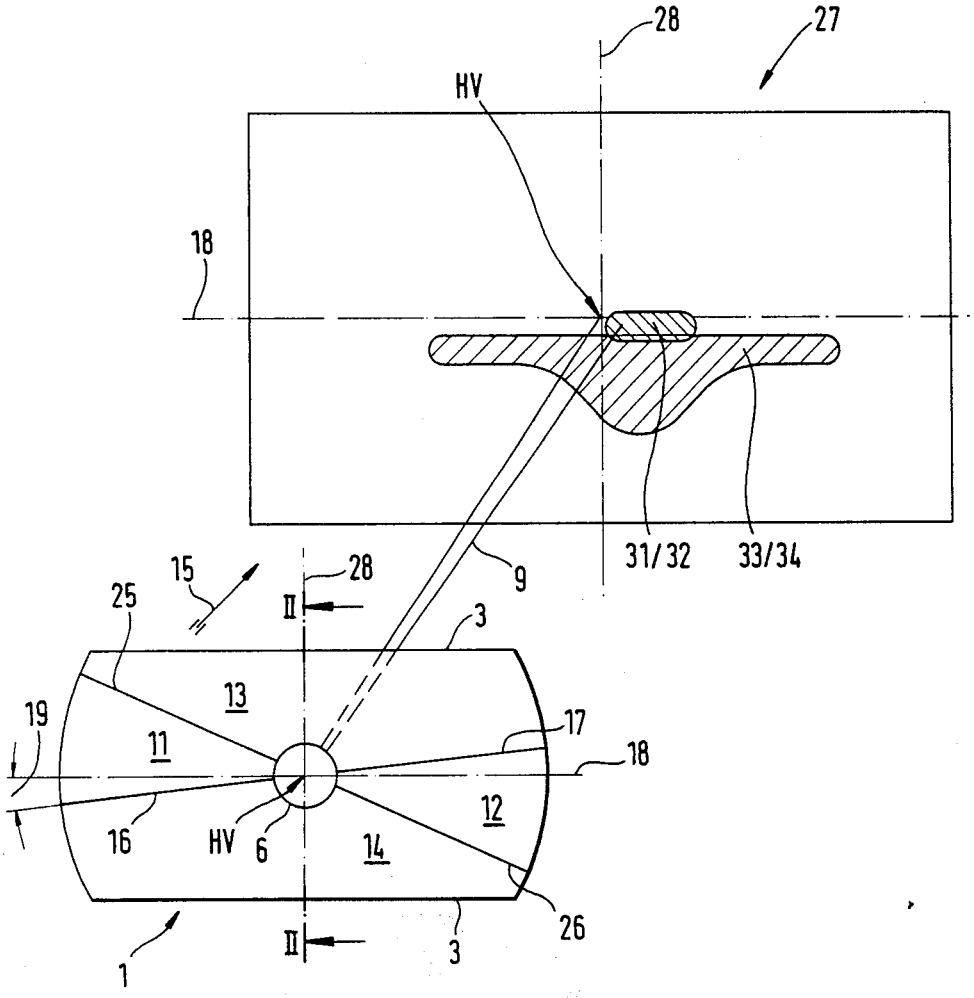
FIG. 1 shows schematically in a rear view a rectangular headlight of this invention projecting an optically untreated dimmed light beam on a measuring screen.
Figure 2:
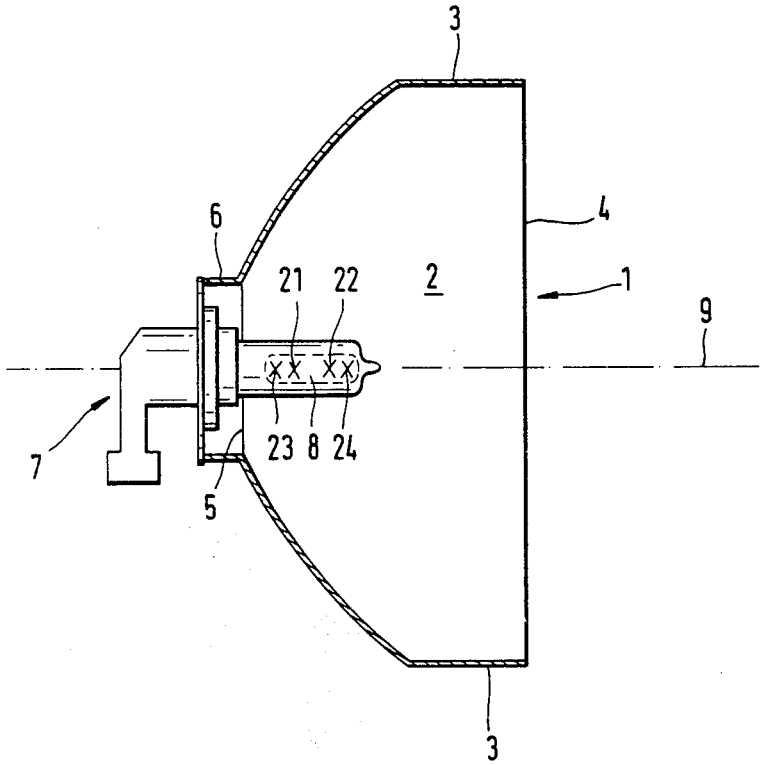
FIG. 2 is a sectional side view of the reflector of FIG. 1 shown on an enlarged scale along the line II—II with inserted single filament incandescent lamp.

The lower beam or dimmed headlamp for motor vehicles illustrated in FIGS. 1 and 2 includes a rectangular reflector 1 whose reflecting surface is delimited at its top and bottom by parallel planar surface portions 3 adjoining the rim aperture 4. The apex portion 5 of the reflector is provided with a neck 6 whose rear end face rests in axial direction on a flange of a single filament incandescent lamp 7 and centers the same in radial direction. The incandescent lamp 7 has a cylindrical coil filament 8 whose center axis extends approximately to the axis 9 of the reflector 1.

The reflecting surface 2 when viewed in the direction of reflected light rays indicated by arrow 15 consists of the following sectors: an upper sector 13 and a lower sector 14, both forming a part of a paraboloid-ellipsoid whose vertical center section 28 is a parabola and whose horizontal center section 18 is a part of an ellipsis. The focal point 23 of the upper sector 13 is located in the rear part of the coil filament 8 that means in the part facing the apex portion 5 of the reflector; the focal point 24 of the lower sector 14 is located in the front part of the incandescent filament 8 (that means in the part facing the rim aperture 4 of the reflector 1). The transition edges 25 and 26 delimiting the upper and lower sectors 13 and 14 are determined empirically.

A left hand sector 11 and a right hand sector 12 when viewed in the direction of arrow 15, are parts of a paraboloid whereby the focal plane of the left sector 11 is located between the focal plane 23 of the upper sector 13 and the focal point 24 of the lower sector 14, whereas the focal point 22 of the right sector 12 is located between the focal point 21 of the left sector 11 and the focal point 24 of then lower sector 14. The focal point 21 of the left sector 11 is arranged close to the focal point 23 of the upper sector 13, whereas the focal point 22 of the right sector 12 is close to the focal point 24 of the lower sector 14.

The left sector 11 and the lower sector 14 adjoin each other along a transition edge 16, and the right sector 12 and the upper sector 13 adjoin along a transition edge 17. The transition edge 16 with respect to the horizontal section plane 18 is turned by about 5° downwards as indicated by arrows 19 and the transition edge 17 is turned upwards relative to the horizontal section 18 also by 5°.

The axis of the paraboloid constituting the left sector 11 and the right sector 12 is inclined by 8/10° upwards relative to the axis of the paraboloid ellipsoid constituting the upper sector 13 and the lower sector 14. In addition, the large axis of the ellipsis of the paraboloid-ellipsoid forming the left sector 11 and the right sector 12 has the length approximately between 200 and 250 mm.

The respective focal lengths in the reflector are as follows:

- 27 mm focal length of the paraboloid of the left sector 11 and right sector 12;
- 23 mm focal length of the parabola in the paraboloid-ellipsoid of the upper sector and 24 mm focal legth of the ellipsis thereof;

26 mm focal length both for the parabola and the ellipsis in the paraboloid-ellipsoid of the lower sector 14.

FIG. 1 illustrates a measuring screen 27 illuminated by reflected light rays emanating from the reflector 1 in the direction of arrow 15; the measuring screen defines a horizontal central section 18 and a vertical central section 28 intersecting at the point HV. The sectors 11 and 12 of the reflector produce a light spot 31, 32 (the so-called "hot spot") and the sectors 13 and 14 project a light spot 33/34 which in comparison to the hot spot has an increased lateral dispersion and deeper fore-field illumination. Due to the fact that the reflector axis 9 and that of the incandescent coil filament 8 are inclined relative to the center point HV of the measuring screen 27 both horizontally to the right and vertically downwards, the original light beam producing the two light spots 31/32 and 33/34 falls below a prescribed limit. Due to the novel configuration or parameter of the reflection surface 2 which according to this invention is the sum of the sectors 11 through 14, the resulting untreated light distribution (the optically untreated light beam) corresponds substantially to the low beam or dimmed light beam transmitted on the road. Consequently, the non-illustrated light dispersing glass of the antiglare headlamp can be manufactured without or only with a limited number of optical means which hitherto had been necessary for the treatment of the original light beam to generate a dimmed or lower light beam.

While the invention has been illustrated and described as embodied in a rectangular type headlight, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An antidazzle headlight, particularly a rectangular reflector type lower beam headlight for motor vehicles, comprising:

(a) a reflector enclosing a substantially cylindrical incandescent coil filament whose axis extends substantially parallel to the axis of the reflector;

(b) the reflector defining a reflecting surface which when viewed in the direction of reflected light rays consists of the following sectors:

(c) an upper sector and a lower sector forming together a part of a paraboloid-ellipsoid whose vertical central section is a parabola and whose horizontal center section is a part of an ellipsis;

(d) the focal point of the upper sector is located in a rear part of the cylindrical coil filament facing an apex part of the reflector;

(e) the focal point of the lower sector being located in a front part of the cylindrical coil filament facing a rim aperture of the reclector;

(f) a left sector and a right sector forming together a part of a paraboloid;

(g) the focal point of the left sector being located between the focal point of the upper sector and the focal point of the lower sector; and (h) the focal point of the right sector being located between the focal point of the left sector and the focal point of the lower sector.

2. A headlight as defined in claim 1, wherein (i) the focal point of the left sector being located close to the focal point of the upper sector and (j) the focal point of the right sector being located close to the focal point of the lower sector.

3. A headlight as defined in claim 1, wherein (k) a transition line (16) between the left sector and the lower sector is inclined at a sharp angle below the horizontal center section plane of the reflector; and (l) a transition line (17) between the right sector and the upper sector is inclined at a sharp angle above said horizontal center section plane.

4. A headlight as defined in claim 3, wherein (m) the inclination of respective transition lines relative to said horizontal center section plane amounts approximately 5°.

5. A headlight as defined in claim 1, wherein (n) the focal length of the paraboloid constituted by the left and right sectors of the reflecting circuit amounts to 27 mm and (o) the axis of said paraboloid relative to the axis of the paraboloid-ellipsoid formed by the upper and lower sectors is inclined upward by a sharp angle.

6. A headlight as defined in claim 5, wherein (p) the inclination of said axis of the paraboloid-ellipsoid relative to the axis of said paraboloid amounts to 8/10°.

7. A headlight as defined in claim 1, wherein (q) the focal length of the paraboloid-ellipsoid surface of the upper sector is 23 mm for the parabola and 24 mm for the ellipsis thereof;

(r) the focal length of the paraboloid-ellipsoid of the lower sector amounts to 26 mm both for the parabola and for the ellipsis thereof; and (s) the large axis of the ellipsis of the paraboloid-ellipsoid forming the left and right sectors amount between 200 to 250 mm.

* * * * *